US011731736B2

(12) United States Patent
Zhang et al.

(10) Patent No.: US 11,731,736 B2
(45) Date of Patent: Aug. 22, 2023

(54) DEEP-SEA MANNED SUBMERSIBLE AND DESIGN METHOD FOR PRESSURE RESISTANT HULL CURVED STRUCTURE THEREOF

(71) Applicant: JIANGSU UNIVERSITY OF SCIENCE AND TECHNOLOGY, Jiangsu (CN)

(72) Inventors: Jian Zhang, Jiangsu (CN); Chen Huang, Jiangsu (CN); Zhihui Jiang, Jiangsu (CN); Wenxian Tang, Jiangsu (CN); Wenwei Wu, Jiangsu (CN); Weibo Wang, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 0 days.

(21) Appl. No.: 17/781,719

(22) PCT Filed: Apr. 16, 2021

(86) PCT No.: PCT/CN2021/087785
§ 371 (c)(1),
(2) Date: Jun. 2, 2022

(87) PCT Pub. No.: WO2022/041789
PCT Pub. Date: Mar. 3, 2022

(65) Prior Publication Data

US 2023/0002008 A1 Jan. 5, 2023

(30) Foreign Application Priority Data

Aug. 28, 2020 (CN) ..... 202010884383.9

(51) Int. Cl.
*B63B 3/13* (2006.01)
*B63G 8/00* (2006.01)

(52) U.S. Cl.
CPC ..... *B63B 3/13* (2013.01); *B63G 8/001* (2013.01)

(58) Field of Classification Search
CPC .... B63B 3/00; B63B 3/13; B63G 8/00; B63G 8/001; B63G 8/08
(Continued)

(56) References Cited

U.S. PATENT DOCUMENTS 4,226,205 A 10/1980 Bastide

FOREIGN PATENT DOCUMENTS

CN 109367681 2/2019
CN 110065606 7/2019
(Continued)

OTHER PUBLICATIONS

"International Search Report (Form PCT/ISA/210) of PCT/CN2021/087785", dated Jul. 21, 2021, with English translation thereof, pp. 1-4.

(Continued)

*Primary Examiner* — Lars A Olson
(74) *Attorney, Agent, or Firm* — JCIPRNET

(57) ABSTRACT

A deep-sea manned submersible and a design method for a pressure resistant hull curved structure thereof, the deep-sea manned submersible comprising a main hull body, a propeller assembly, annular sliding channels, a brake disc, and a brake. Two annular sliding channels are provided, and are fixed symmetrically on two opposite side surfaces of the main hull body. The main hull body is inserted vertically through the upper surface of the propeller assembly, and by means of the two annular sliding channels is slidingly connected to the propeller assembly, such that the outer contour of the whole body formed by the impeller assembly and the main hull body takes a nautilus shell shape. The brake disc is of an annular shape, and fixed on an outer ring
(Continued)

of the main hull body, and the brake is mounted on the propeller assembly and corresponds matchingly with the brake disc.

12 Claims, 6 Drawing Sheets

(58) Field of Classification Search
USPC ..... 114/312
See application file for complete search history.

(56) References Cited

FOREIGN PATENT DOCUMENTS

| | | |
|---|---|---|
| CN | 112182738 | 1/2021 |
| TW | 201930146 | 8/2019 |

OTHER PUBLICATIONS

"Written Opinion of the International Searching Authority (Form PCT/ISA/237) of PCT/ CN2021/087785", dated Jul. 21, 2021, with English translation thereof, pp. 1-10.

DEEP-SEA MANNED SUBMERSIBLE AND DESIGN METHOD FOR PRESSURE RESISTANT HULL CURVED STRUCTURE THEREOF

CROSS-REFERENCE TO RELATED APPLICATION

This application is a 371 of international application of PCT application serial no. PCT/CN2021/087785, filed on Apr. 16, 2021, which claims the priority benefit of China application no. 202010884383.9, filed on Aug. 28, 2020. The entirety of each of the above-mentioned patent applications is hereby incorporated by reference herein and made a part of this specification.

TECHNICAL FIELD

The present disclosure relates to the field of underwater vehicles, and more particularly to a deep-sea manned submersible and a design method for a pressure resistant hull curved structure thereof.

DESCRIPTION OF RELATED ART

Submersibles are mainly used for efficient exploration and exploitation of marine resources, scientific research, military exploration and salvage, and other aspects.

The submersible needs to adjust its bearing according to the submarine topography as it moves under the sea. Before the submersible dives, the buoyancy coefficient of the submersible needs to be calculated so that the submersible can have enough gravity to dive into the deep sea. After completing the operation, the submersible needs to float. In the process of floating, it is necessary to abandon heavy objects in the submersible to make the gravity of the submersible less than the buoyancy, to complete the floating action. The process is tedious and pollutes the environment.

SUMMARY

Invention objective: In view of the foregoing problems, the present disclosure aims to provide a deep-sea manned submersible, which implements active bearing adjustment of the submersible and facilitates realization of floating. The present disclosure further provides a design method for a pressure resistant hull curved structure of the submersible.

Technical solution: A deep-sea manned submersible is provided, including a main hull body, a propeller assembly, annular sliding channels, a brake disc, and a brake, where two annular sliding channels are provided, and are fixed symmetrically on two opposite side surfaces of the main hull body; the main hull body is inserted vertically through the upper surface of the propeller assembly, and by means of a sliding connection between the two annular sliding channels and the propeller assembly, the outer contour of the whole body formed by the propeller assembly and the main hull body takes a nautilus shell shape; and the brake disc is of an annular shape and fixed on an outer ring of the main hull body, and the brake is mounted on the propeller assembly and corresponds matchingly with the brake disc.

Further, the main hull body includes a first half hull, a second half hull, a ring flange, an inspection window, and a closure head, where the first half hull and the second half hull are connected to each other to form a hollow shell structure with a circular outer circumference, and the brake disc is fixed on a joint face between the first half hull and the second half hull; the ring flange is connected to an outer side face of the first half hull via a plurality of bolts; and the inspection window is disposed on the outer circumferential face of the second half hull, and the closure head is disposed on an outer side face of the second half hull.

Further, a plurality of circumferentially distributed radial partition plates and a plurality of circumferential partition plates are disposed in an inner cavity of the circular hollow hull body formed by the first half hull and the second half hull, where the circumferential partition plates are distributed in a radial direction from the center of the circle and have progressively increasing diameters; and the plurality of radial partition plates and the plurality of circumferential partition plates are combined to form a plurality of chambers.

Preferably, each of the radial partition plates is provided with a least two channels communicating with the chambers.

Further, a seal ring is disposed on a joint face between each bolt and the ring flange, and a sealing gasket is disposed on a joint face between the ring flange and the first half hull.

Further, a middle portion in the main hull body is a control chamber and the bottom portion thereof is an electromechanical equipment chamber.

Further, the propeller assembly includes propellers and a secondary hull body, where an arc-shaped groove is provided on the secondary hull body and two sliders are symmetrically disposed on two opposite inner side surfaces of the groove; the main hull body is inserted into the arc-shaped groove so that the two sliders are fitted into the two corresponding annular sliding channels; the outer contour of the whole body formed by the secondary hull body and the main hull body takes a nautilus shell shape; at least two propellers are disposed and separately mounted on the upper surface of the secondary hull body; and the brake is mounted on the same surface of the secondary hull body as the propellers.

Preferably, four propellers are disposed, two of which are mounted in a forward direction and the other two are mounted in a reverse direction.

Further, the brake includes an air cylinder, an air cylinder base, and friction plates, where the air cylinder is mounted on the propeller assembly via the air cylinder base; and two friction plates are disposed, and oppositely mounted on two opposite sides of the brake disc and connected to the air cylinder.

A design method for a pressure resistant hull curved structure of the deep-sea manned submersible is provided, which includes the following steps:

step 1. establishing a space rectangular coordinate system at a small end of the propeller assembly, where a curved surface of the propeller assembly is enclosed by an outer generatrix, an inner generatrix, and a cross-sectional curve; the outer generatrix is a Fibonacci spiral and in the XZ plane; the inner generatrix is a semicircle and in the XZ plane; and the cross-sectional curve is an elliptic line and in the YZ plane;

step 2. establishing an X-Y rectangular coordinate system at one end of a long axis of the meridian of the elliptic line, where a meridian equation is $f(x,y)=0$, and then $$\frac{(x+a)^2}{a^2}+\frac{y^2}{b^2}=1;$$

an ellipsoid is obtained by 180° axial rotation of the meridian ellipse about a straight line $$\begin{cases} x=a \\ z=0 \end{cases};$$

and therefore, $$f\left(\pm\sqrt{x^2+z^2},\, y\right)=0,$$

and an equation of the curved surface of the nautilus shell shape is $$\frac{(x+a)^2+z^2}{a^2}+\frac{y^2}{b^2}=1;$$

step 3. the outer generatrix of the curved surface of the propeller assembly being a Fibonacci spiral, and the spiral being formed by two semicircles; the semicircle radius r meeting the Fibonacci sequence and the formula being $$\begin{cases} r_1=1 \\ r_2=1 \\ r_{n+2}=r_n+r_{n+1} \end{cases};$$

a general term formula being $$r_n=\frac{1}{\sqrt{5}}\left[\left(\frac{1+\sqrt{5}}{2}\right)^n-\left(\frac{1-\sqrt{5}}{2}\right)^n\right],\ n=1,2,$$

and the inner generatrix being a semicircle with a radius set to $r_3$;

step 4. the value of BC being $$BC=\frac{r_{n+1}(r_{n+1}-r_n)}{r_{n+1}-r_n},$$

and the value of α being $$\alpha=\arctan\frac{BC}{r_{n+1}}=\arctan\frac{r_{n+1}-r_n}{r_{n+1}-r_n};$$

step 5. calculating the coordinates of the centers of the two semicircles as ($r_n$ cos α–, $r_n$ sin α) and $$\left(\frac{r_n}{\cos\alpha}+\frac{r_{n+1}(r_{n+1}-r_n)}{r_{n+1}-r_n}\sin\alpha,\ -r_{n+1}\sin\alpha\right)$$

respectively, and then the polar equation of the spiral being as follows:

$$\begin{cases} \rho'=\rho_1\cos(\theta-\alpha)+\sqrt{\rho_1^2\cos^2(\theta-\alpha)-\rho_1^2+r_n^2},\ \theta\epsilon\left(\frac{\pi}{4}+\alpha,\ \frac{\pi}{2}+\alpha\right] \\ \rho''=\rho_2\cos(\theta-\alpha)+\sqrt{\rho_2^2\cos^2(\theta-\alpha)-\rho_2^2+r_{n+1}^2},\ \alpha\epsilon\left[0,\ \frac{\pi}{4}+\alpha\right] \\ \rho_1=r_n \\ \theta_1=\arctan\frac{r_{n+1}-r_n}{r_{n+1}-r_n} \\ \rho_2=\sqrt{\left(\frac{r_n}{\cos\alpha}+\frac{r_{n+1}(r_{n+1}-r_n)}{r_{n+1}-r_n}\sin\alpha\right)^2+r_{n+1}^2\sin^2\alpha} \\ \theta_2=\arctan\frac{-r_{n+1}\sin\alpha\cos\alpha}{r_n+\frac{r_{n+1}(r_{n+1}-r_n)}{r_{n+1}-r_n}\sin\alpha\cos\alpha} \end{cases}$$

, where $\rho'$ is the polar equation of the small circle and ρ" is the polar equation of the big circle;

step 6. defining any point P on the spiral, where OP intersects with the inner generatrix at the point P', and then, the length of PP' is $$d=\sqrt{(\rho\cos\theta-a)^2+\rho^2\sin^2\theta};$$

and step 7. the curved surface of the propeller being obtained by 180° rotation of a large elliptic curve about the straight line $$\begin{cases} x=a \\ z=0 \end{cases}$$

along the path curve to a small elliptic curve, to obtain the function of the curved surface of the propeller as follows:

$$
\begin{cases}
\dfrac{(x-e)^2+z^2}{d^2}+\dfrac{y^2}{b^2\left(1-\dfrac{(e+a)^2}{a^2}\right)}=1 \\
d=\sqrt{(\rho\cos\theta-a)^2+\rho^2\sin^2\theta} \\
\rho=\rho_1\cos(\theta-\alpha)+\sqrt{\rho_1^2\cos^2(\theta-\alpha)-\rho_1^2+r_n^2},\ \theta\epsilon\left(\dfrac{\pi}{4}+\alpha,\ \dfrac{\pi}{2}+\alpha\right] \\
\rho=\rho_2\cos(\theta-\alpha)+\sqrt{\rho_2^2\cos^2(\theta-\alpha)-\rho_2^2+r_{n+1}^2},\ \alpha\epsilon\left[0,\ \dfrac{\pi}{4}+\alpha\right] \\
\rho_1=r_n \\
\theta_1=\arctan\dfrac{r_{n+1}-r_n}{r_{n+1}-r_n} \\
\rho_2=\sqrt{\left(\dfrac{r_n}{\cos\alpha}+\dfrac{r_{n+1}(r_{n+1}-r_n)}{r_{n+1}-r_n}\sin\alpha\right)^2+r_{n+1}^2\sin^2\alpha} \\
\theta_2=\arctan\dfrac{-r_{n+1}\sin\alpha\cos\alpha}{r_n+\dfrac{r_{n+1}(r_{n+1}-r_n)}{r_{n+1}-r_n}\sin\alpha\cos\alpha}
\end{cases}
$$

Beneficial effects: Compared to the prior art, the present disclosure has the following advantages: The pressure resistant hull, the outer contour of which forms a nautilus shell shaped structure, cooperatively formed by means of the propeller assembly and the main hull body has better hydrodynamic power. By means of circumferential rotation of the propeller assembly about the main hull body, active bearing adjustment of the submersible is realized, and further active braking is realized by cooperation between the brake disc and the brake. The degree of freedom of the submersible is controlled by starting/stopping the propeller assembly, such that the submersible can float and dive more conveniently and rapidly, and can adapt to the complex conditions and harsh environment of the deep sea. Moreover, the nautilus-shaped submersible can be divided into more chambers; features good pressure resistance characteristics; and has a high space utilization in the hull, good hydrodynamic performance and a large amount of reserve buoyancy.

Figure 1:
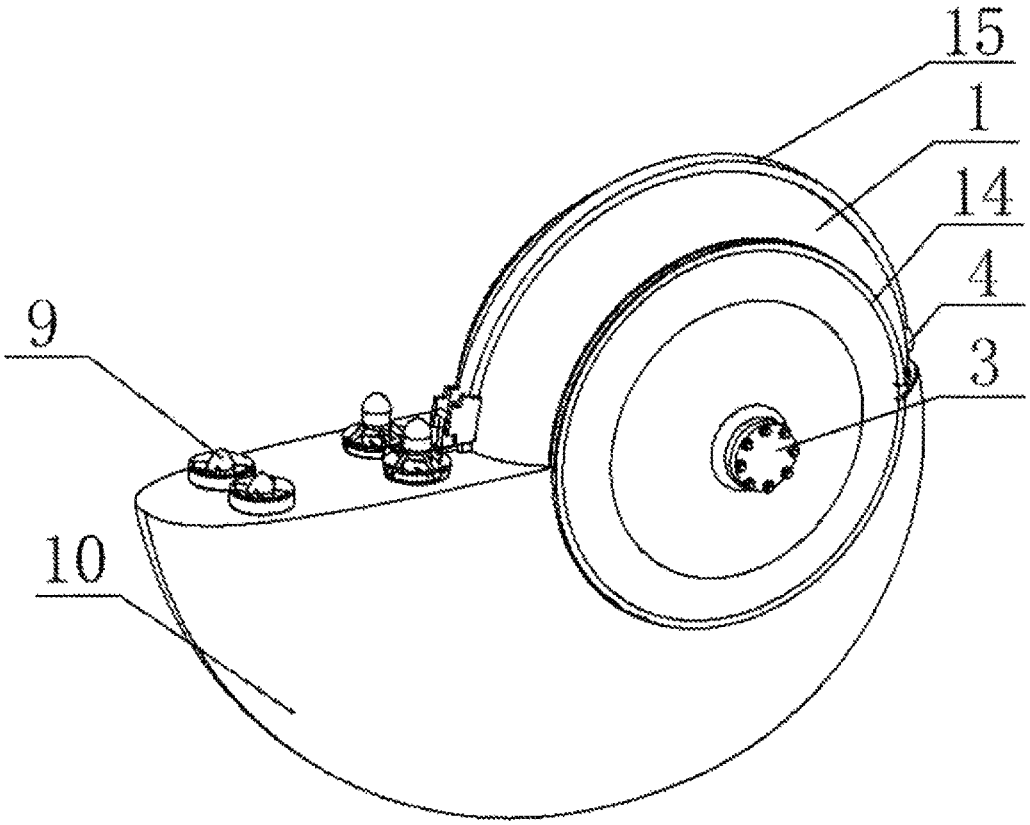
FIG. 1 is a schematic three-dimensional structural diagram of a side where a ring flange is located in the present disclosure.
Figure 2:
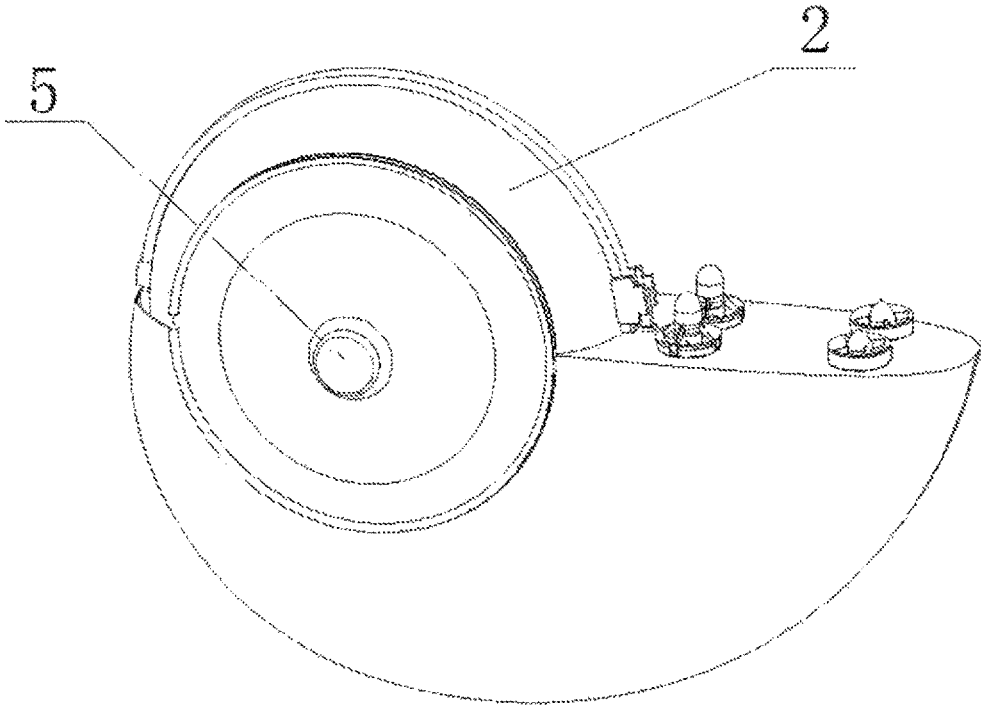
FIG. 2 is a schematic three-dimensional structural diagram of a side where a closure head located in the present disclosure.
Figure 3:
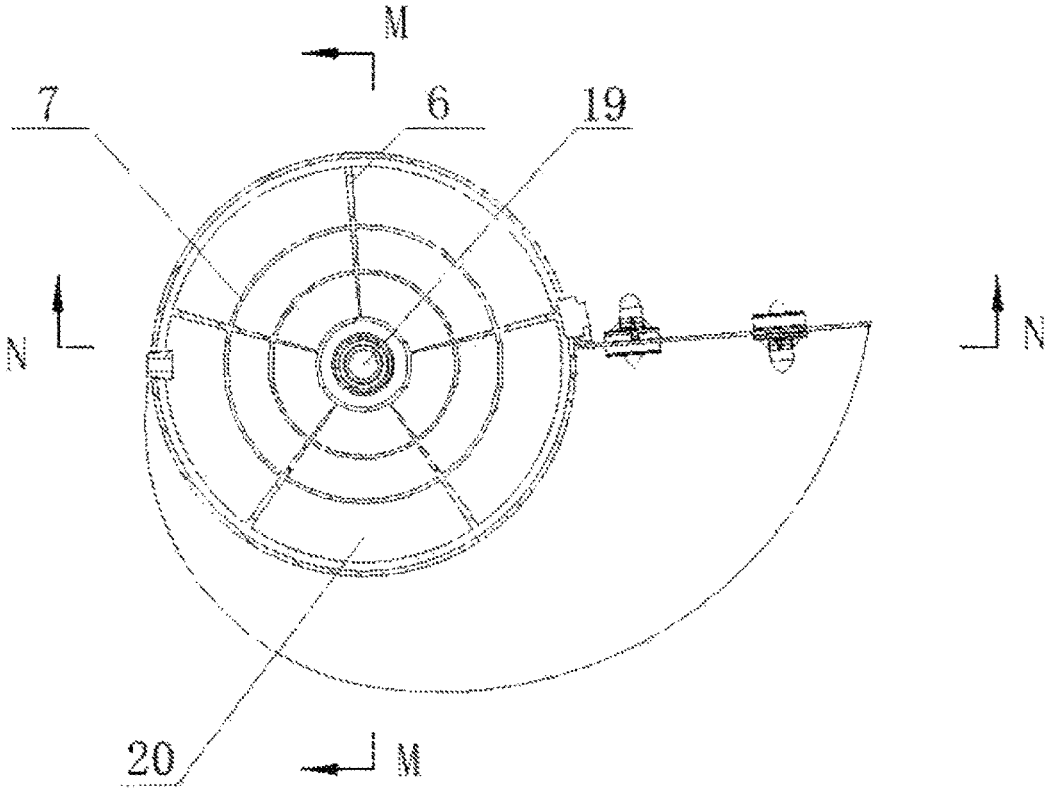
FIG. 3 is a sectional front view of a main hull body of the present disclosure.
Figure 4:
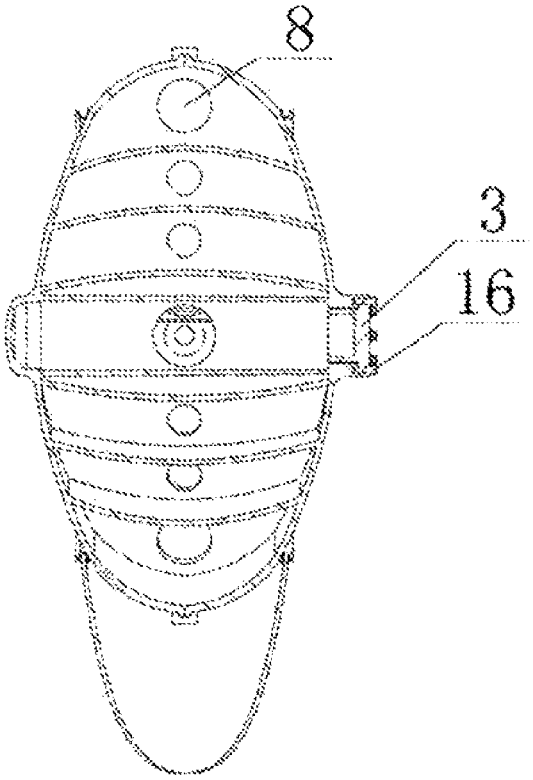
FIG. 4 is an M-M sectional diagram of FIG. 3.
Figure 5:
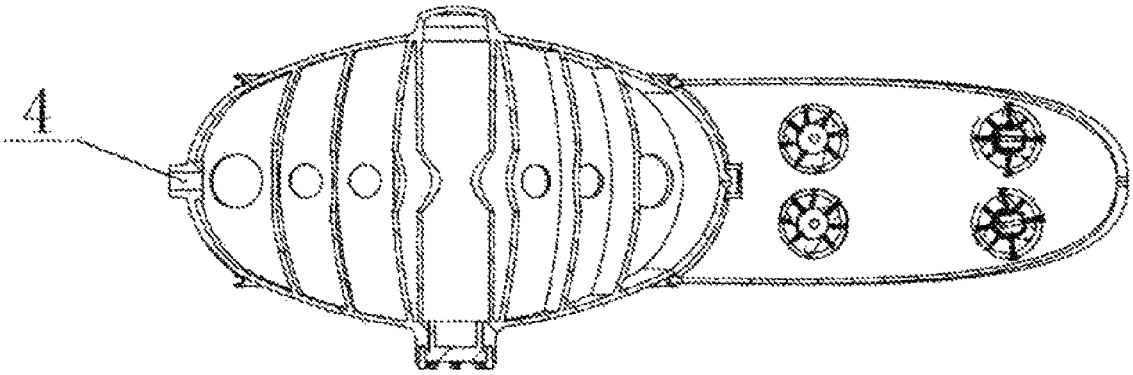
FIG. 5 is an N-N sectional diagram of FIG. 3.
Figure 6:
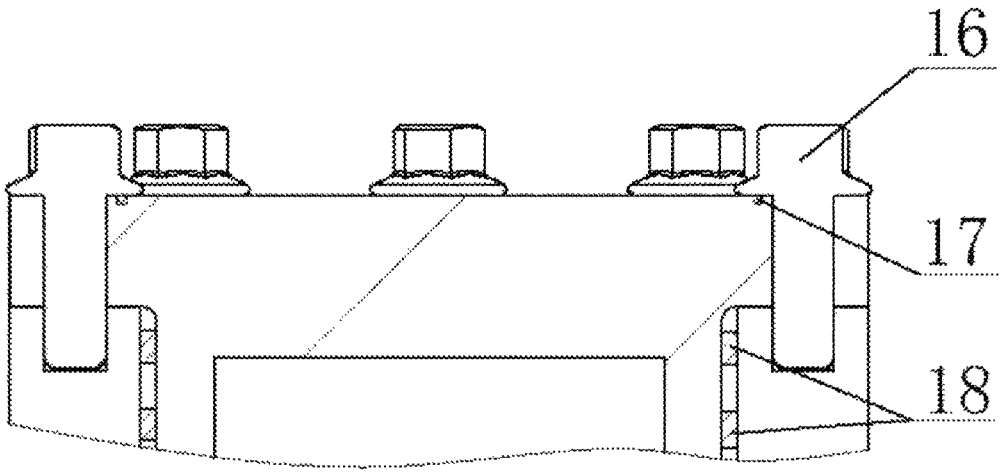
FIG. 6 is a schematic structural diagram showing connection of the ring flange.

Meanings of numerals: 1. First half hull; 2. Second half hull; 3. Ring flange; 4. Inspection window; 5. Closure head; 6. Radial partition plate; 7. Circumferential partition plate; 8. Channel; 9. Propeller; 10. Secondary hull body; 11. Air cylinder; 12. Air cylinder base; 13. Friction plate; 14. Annular sliding channel; 15. Brake disc; 16. Bolt; 17. Seal ring; 18. Sealing gasket; 19. Control chamber; 20. Electromechanical equipment chamber; 101. Elliptic curve; 102. Cross-sectional curve; 103. Outer generatrix; 104. Inner generatrix.

DETAILED DESCRIPTION OF THE EMBODIMENTS

The present disclosure is further described below with reference to the accompanying drawings and specific embodiments. It should be understood that these embodiments are merely used for describing the present disclosure rather than limiting the scope of the present disclosure.

A deep-sea manned submersible, as shown in FIGS. 1 to 7, includes a main hull body, a propeller assembly, annular sliding channels 14, a brake disc 15, and a brake. The main hull body includes a first half hull 1, a second half hull 2, a ring flange 3, an inspection window 4, and a closure head 5. The first half hull 1 and the second half hull 2 are connected to each other to form a hollow shell structure with a circular outer circumference. The brake disc 15 is an annular shape, and is fixed on a joint face between the first half hull and the second half hull and protrudes from outer circumferential faces of the two half hulls. The ring flange 3 is connected to an outer side face of the first half hull 1 via a plurality of bolts 16, a seal ring 17 is disposed on a joint face between each bolt 16 and the ring flange 3, and a sealing gasket 18 is disposed on a joint face between the ring flange 3 and the first half hull 1. The inspection window 4 is disposed on the outer circumferential face of the second half hull 2, and the closure head 5 is disposed on an outer side face of the second half hull 2. A plurality of circumferentially distributed radial partition plates 6 and a plurality of circumferential partition plates 7 are disposed in an inner cavity of the circular hollow hull body formed by the first half hull 1 and the second half hull 2, where the circumferential partition plates 7 are distributed in a radial direction from the center of the circle and have progressively increasing diameters. The plurality of radial partition plates 6 and the plurality of circumferential partition plates 7 are combined to form a plurality of chambers, where each radial partition plate 6 is provided with a least two channels 8 communicating with the chambers. A middle portion in the main hull body is a control chamber 19 and the bottom portion thereof is an electromechanical equipment chamber 20.

Two annular sliding channels 14 are provided, and are respectively fixed on the first half hull 1 and the second half hull 2 symmetrically, where a slide chute is provided on an upper surface of each sliding channel 14. The propeller assembly includes propellers 9 and a secondary hull body 10, where an arc-shaped groove is provided on the secondary hull body 10 and two sliders are symmetrically disposed on two opposite inner side surfaces of the groove. The main hull body is inserted vertically into the arc-shaped groove so that the two sliders are fitted into the corresponding slide chutes on the two annular sliding channels 14. The outer contour of the whole body formed by the secondary hull body 10 and the main hull body takes a nautilus shell shape. At least two propellers 9 are disposed. If four propellers are disposed, two of them are mounted in a forward direction and the other two are mounted in a reverse direction, and they are separately mounted on a deck on the upper surface of the secondary hull body 10. The brake is mounted on the same surface of the secondary hull body 10 as the propellers 9; and includes an air cylinder 11, an air cylinder base 12, and friction plates 13. The air cylinder 11 is mounted on the secondary hull body 10 via the air cylinder base 12. Two friction plates 13 are disposed, and oppositely mounted on two opposite sides of the brake disc 15 and connected to the air cylinder 11.

The ring flange functions as an entrance and exit of the submersible. By starting the forward propellers or the reverse propellers, the propeller assembly can rotate clockwise or counterclockwise about the main hull body via the annular sliding channels and the sliders, thus realizing active bearing adjustment of the whole submersible. The degree of freedom of the submersible is controlled by starting/stopping the propeller assembly, such that the submersible can float and dive more conveniently and rapidly, and can adapt to the complex conditions and harsh environment of the deep sea. In addition, by the cooperation between the brake disc and the brake, the two friction plates can lock the brake disc by starting the air cylinder, thus implementing active braking, such that the propeller assembly is stopped at a required position.

Figure 7:
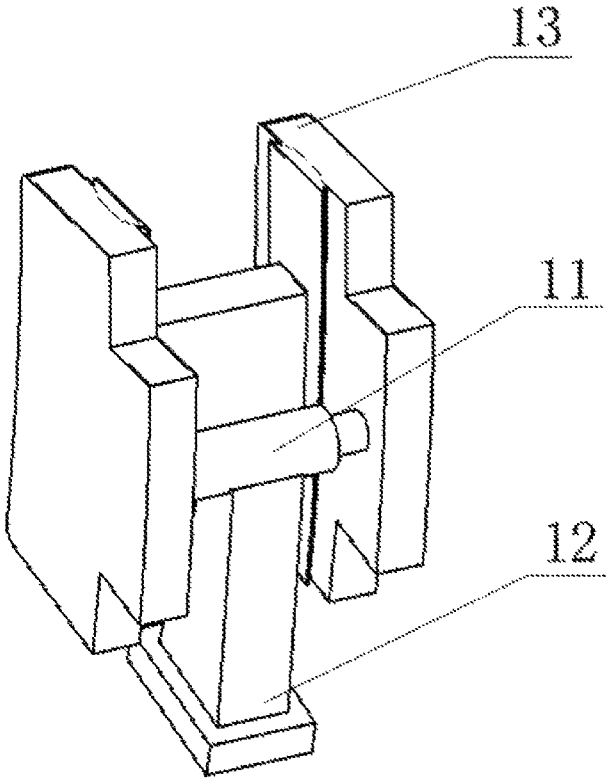
FIG. 7 is a schematic structural diagram of a brake.

A design method for a pressure resistant hull curved structure of the deep-sea manned submersible, as shown in FIGS. 8 to 11, includes the following steps:

Step 1. As shown in FIG. 7, a space rectangular coordinate system is established at a small end of the propeller assembly, and a curved surface of the propeller assembly is enclosed by an outer generatrix 103, an inner generatrix 104, and a cross-sectional curve 102. The outer generatrix 103 is a Fibonacci spiral and in the XZ plane; the inner generatrix 104 is a semicircle and in the XZ plane; and the cross-sectional curve 102 is an elliptic line and in the YZ plane.

Figure 8:
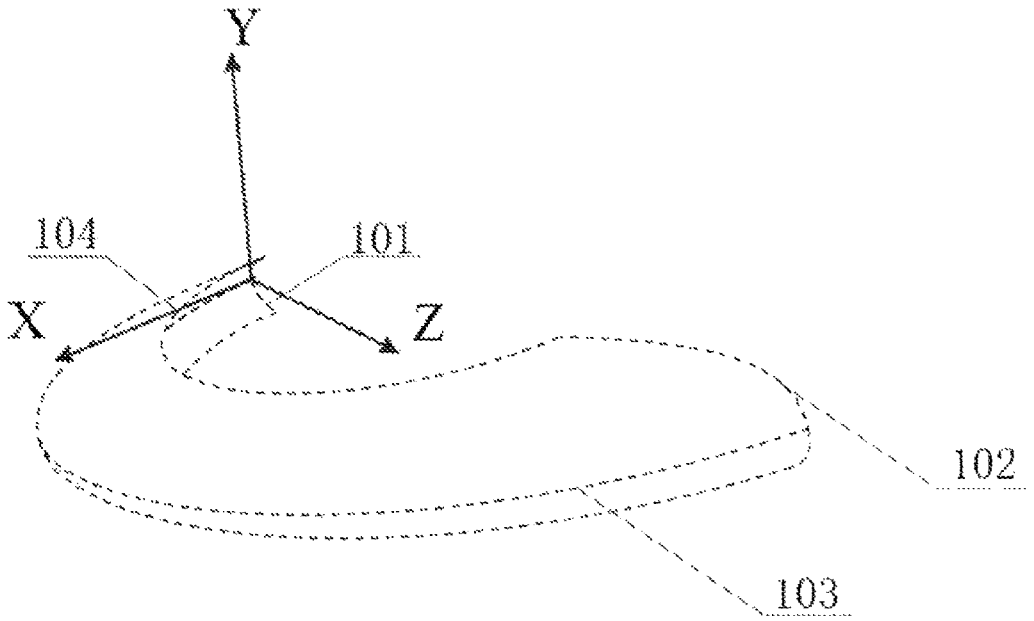
FIG. 8 is an axonometric drawing of a secondary hull body of the present disclosure.

Step 2. As shown in FIG. 8, a nautilus-shaped pressure resistant hull is an ellipsoidal hull body. An X-Y rectangular coordinate system is established at one end of a long axis of the elliptic meridian, where a meridian equation is f(x,y)=0, and then $$\frac{(x+a)^2}{a^2}+\frac{y^2}{b^2}=1.$$

The ellipsoid may be obtained by 180° axial rotation of the meridian ellipse about a straight line $$\begin{cases} x=a \\ z=0 \end{cases}.$$

Therefore, $$f\left(\pm\sqrt{x^2+z^2},\, y\right)=0,$$

and an equation of the curved surface of the ellipsoid is $$\frac{(x+a)^2+z^2}{a^2}+\frac{y^2}{b^2}=1.$$

Figure 9:
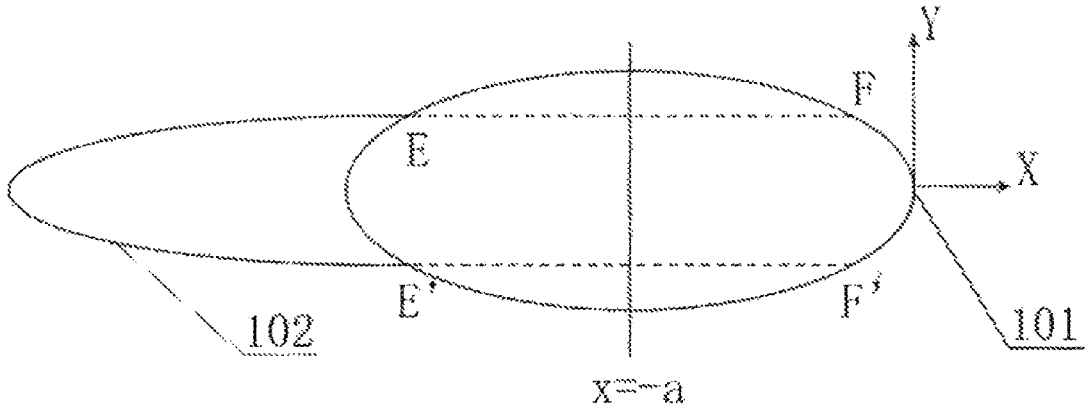
FIG. 9 is an X-Y view of a simplified secondary hull body.
Figure 10:
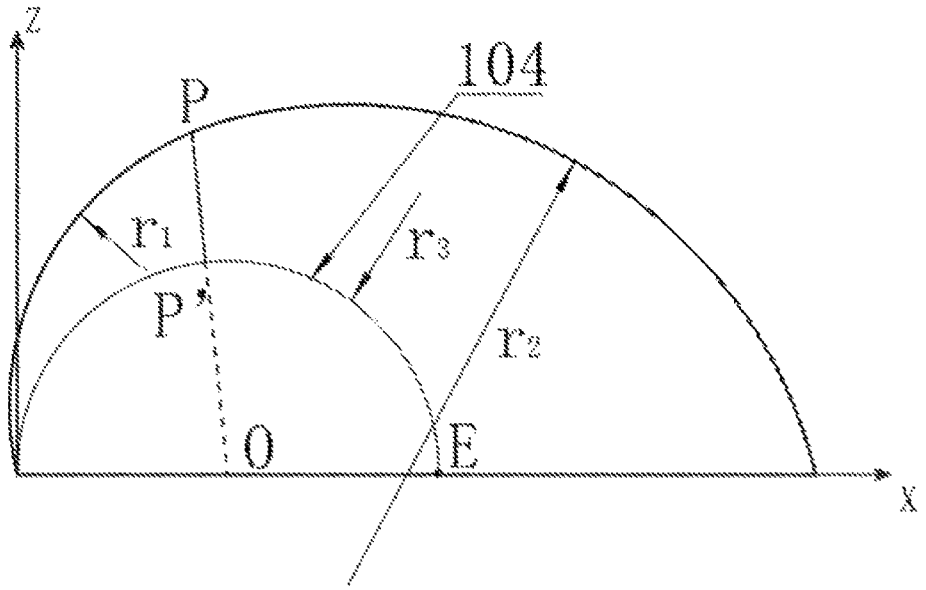
FIG. 10 is an X-Z view of a spiral of the simplified secondary hull body.

Step 3. As shown in FIGS. 9 and 10, the outer generatrix 103 of the curved surface of the propeller is a Fibonacci spiral, and the spiral is formed by two semicircles, where the semicircle radius r meets the Fibonacci sequence and the formula is $$\begin{cases} r_1=1 \\ r_2=1 \\ r_{n+2}=r_n+r_{n+1} \end{cases};$$

a general term formula is $$r_n=\frac{1}{\sqrt{5}}\left[\left(\frac{1+\sqrt{5}}{2}\right)^n-\left(\frac{1-\sqrt{5}}{2}\right)^n\right],\ n=1,2,$$

and the inner generatrix 104 is a semicircle with a radius set to $r_3$.

Figure 11:
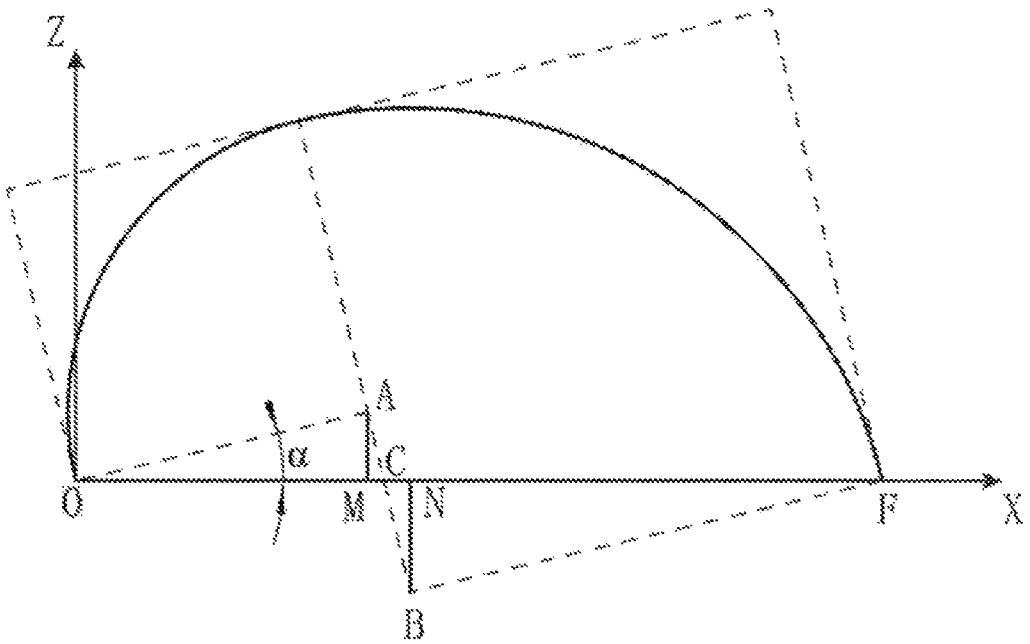
FIG. 11 is an X-Z view of the simplified secondary hull body.

Step 4. As shown in FIG. 11, the value of BC is $$BC=\frac{r_{n+1}(r_{n+1}-r_n)}{r_{n+1}-r_n},$$

and the value of α is $$\alpha=\arctan\frac{BC}{r_{n+1}}=\arctan\frac{r_{n+1}-r_n}{r_{n+1}-r_n}.$$

Step 5. The coordinates of the centers of the two semicircles may be calculated as ($r_n$ cos α–, $r_n$ sin α) and $$\left(\frac{r_n}{\cos\alpha}+\frac{r_{n+1}(r_{n+1}-r_n)}{r_{n+1}-r_n}\sin\alpha,\ -r_{n+1}\sin\alpha\right)$$

respectively, and then the polar equation of the spiral 1-3 is as follows:

$$\begin{cases} \rho'=\rho_1\cos(\theta-\alpha)+\sqrt{\rho_1^2\cos^2(\theta-\alpha)-\rho_1^2+r_n^2},\ \theta\epsilon\left(\frac{\pi}{4}+\alpha,\ \frac{\pi}{2}+\alpha\right] \\ \rho''=\rho_2\cos(\theta-\alpha)+\sqrt{\rho_2^2\cos^2(\theta-\alpha)-\rho_2^2+r_{n+1}^2},\ \alpha\epsilon\left[0,\frac{\pi}{4}+\alpha\right] \\ \rho_1=r_n \\ \theta_1=\arctan\frac{r_{n+1}-r_n}{r_{n+1}-r_n} \\ \rho_2=\sqrt{\left(\frac{r_n}{\cos\alpha}+\frac{r_{n+1}(r_{n+1}-r_n)}{r_{n+1}-r_n}\sin\alpha\right)^2+r_{n+1}^2\sin^2\alpha} \\ \theta_2=\arctan\frac{-r_{n+1}\sin\alpha\cos\alpha}{r_n+\frac{r_{n+1}(r_{n+1}-r_n)}{r_{n+1}-r_n}\sin\alpha\cos\alpha} \end{cases}$$

, where $\rho'$ is the polar equation of the small circle and ρ" is the polar equation of the big circle.

Step 6. Any point P is defined on the spiral 103, and OP intersects with the inner generatrix at the point P'. Then, the length of PP' is $$d = \sqrt{(\rho\cos\theta - a)^2 + \rho^2\sin^2\theta}.$$

Step 7. The curved surface of the propeller may be obtained by 180° rotation of the large elliptic curve 102 about the straight line $$\begin{cases} x = a \\ z = 0 \end{cases}$$

along the path curve 103 to a small elliptic curve 101, and therefore, the function of the curved surface of the propeller is as follows:

$$\begin{cases} \dfrac{(x-e)^2 + z^2}{d^2} + \dfrac{y^2}{b^2\left(1 - \dfrac{(e+a)^2}{a^2}\right)} = 1 \\ d = \sqrt{(\rho\cos\theta - a)^2 + \rho^2\sin^2\theta} \\ \rho = \rho_1\cos(\theta-\alpha) + \sqrt{\rho_1^2\cos^2(\theta-\alpha) - \rho_1^2 + r_n^2},\ \theta\epsilon\left(\dfrac{\pi}{4} + \alpha, \dfrac{\pi}{2} + \alpha\right] \\ \rho = \rho_2\cos(\theta-\alpha) + \sqrt{\rho_2^2\cos^2(\theta-\alpha) - \rho_2^2 + r_{n+1}^2},\ \alpha\epsilon\left[0, \dfrac{\pi}{4} + \alpha\right] \\ \rho_1 = r_n \\ \theta_1 = \arctan\dfrac{r_{n+1} - r_n}{r_{n+1} - r_n} \\ \rho_2 = \sqrt{\left(\dfrac{r_n}{\cos\alpha} + \dfrac{r_{n+1}(r_{n+1} - r_n)}{r_{n+1} - r_n}\sin\alpha\right)^2 + r_{n+1}^2\sin^2\alpha} \\ \theta_2 = \arctan\dfrac{-r_{n+1}\sin\alpha\cos\alpha}{r_n + \dfrac{r_{n+1}(r_{n+1} - r_n)}{r_{n+1} - r_n}\sin\alpha\cos\alpha} \end{cases}$$

This method mainly makes a design for the curved surface of the secondary hull body; and further by establishing a rectangular coordinate system on the submersible, calculates an equation of the curved surface of the nautilus-shaped submersible and an equation of the curved surface of the nautilus-shaped propeller, thus providing a novel nautilus-shaped submersible different from the conventional spherical submersible. Compared to the conventional spherical submersible, the nautilus-shaped submersible can be divided into more chambers; features good pressure resistance characteristics; and has a high space utilization in the hull, good hydrodynamic performance and a large amount of reserve buoyancy.

To further verify the superiority of the nautilus-shaped hull body, a strength verification method of the submersible of the present disclosure is given below, which includes the following steps:

Step 1. Material selection: The material is a titanium alloy and has the following parameters: an elastic modulus E of 110 GPa, a Poisson's ratio v of 0.3, and a yield strength ay of 830 Mpa.

Step 2. A working depth $h_g$ of the submersible is set to 6000 m, and a limit depth $h_{jx}$ is calculated, where the limit depth $h_{jx}$ refers to a maximum depth the submersible can dive to and its calculation formula is:

$$h_{jx} = \frac{h_g}{0.90}.$$

Through calculation, the limit depth $h_{jx}$=6666.67 m of the submersible can be obtained.

Step 3. A calculation depth $h_j$ is calculated, where the calculation depth $h_j$ refers to a depth greater than the limit depth in consideration of the margin of strength and is calculated by using the following formula:

$$h_j = Kh_{jx}$$

By setting the safety factor K to 1.5, the calculation depth $h_j$=10000 m can be obtained.

Step 4. A calculation pressure $P_j$ is calculated by using the following formula:

$$P_j = \mu g h_j$$

By setting the seawater density to $\rho = 1.07\times10^3$ kg/m$^2$ and the acceleration of gravity to g=9.8 m/s$^2$, the calculation pressure $P_j$=104 MPa can be obtained.

Step 5. The stress a of the pressure resistant hull is calculated by using the following formula:

$$t \geq \frac{P_j R}{2[\sigma]} = \frac{P_j R}{2\times0.85\sigma_s},\ \sigma = \frac{P_j R}{2t}$$

By setting the maximum radius to R=5 m and the thickness to R=0.4 m, σ=650 MPa can be obtained.

Step 6. An average value of first radii of curvature is calculated by using the following formula:

$$\overline{R_1(x)} = \left|\frac{(1+y'^2)^{\frac{3}{2}}}{y''}\right|,\ y' = -\frac{x}{25y},\ y'' = -\frac{1}{25}\frac{1}{y} - \frac{x^2}{625y^3},$$

$\overline{R_1(x)}$=14.44 mm can be obtained.

Step 7. An average value of second radii of curvature is calculated by using the following formula:

$$\overline{R_2(x)} = y\sqrt{1+y'^2},$$

and then $\overline{R_2(x)}$=0.80 mm can be obtained.

Step 8. The critical buckling load of the pressure resistant hull is calculated by using the following formula:

$$q_{cr} = \frac{2Et^2}{(2\overline{R_1} - \overline{R_2})\overline{R_2}}\left[\frac{1}{3(1-\nu^2)}\right]^{\frac{1}{2}},$$

and then $q_{cr}$=955.84 MPa can be obtained.

Step 9. The calculation results of steps 5 and 6 are verified, which meet that $q_{cr}$=955.84 MPa>$P_j$=104 MPa, and σ=650 MPa<0.85$\sigma_y$=705.5 MPa.

Step 10. If step 9 is met, it indicates that the submersible meets the design requirements; or otherwise, the submersible is redesigned and steps 1 to 8 are repeated.

The method can rapidly predict the strength of the pressure resistant hull of the submersible, thus accurately defining the dimensions and material allowable values of the pressure resistant hull of the submersible and improving the strength analysis efficiency.

What is claimed is:

1. A deep-sea manned submersible, comprising a main hull body, a propeller assembly, annular sliding channels, a brake disc, and a brake, wherein two annular sliding channels are provided, and are fixed symmetrically on two opposite side surfaces of the main hull body; the main hull body is inserted vertically through the upper surface of the propeller assembly, and by means of a sliding connection between the two annular sliding channels and the propeller assembly, an outer contour of a whole body formed by the propeller assembly and the main hull body takes a nautilus shell shape; and the brake disc is of an annular shape and fixed on an outer ring of the main hull body, and the brake is mounted on the propeller assembly and corresponds matchingly with the brake disc.

2. The deep-sea manned submersible according to claim 1, wherein the main hull body comprises a first half hull, a second half hull, a ring flange, an inspection window, and a closure head; the first half hull and the second half hull are connected to each other to form a hollow shell structure with a circular outer circumference, and the brake disc is fixed on a joint face between the first half hull and the second half hull; the ring flange is connected to an outer side face of the first half hull via a plurality of bolts; and the inspection window is disposed on an outer circumferential face of the second half hull, and the closure head is disposed on an outer side face of the second half hull.

3. The deep-sea manned submersible according to claim 2, wherein a plurality of circumferentially distributed radial partition plates and a plurality of circumferential partition plates are disposed in an inner cavity of the circular hollow hull body formed by the first half hull and the second half hull, the circumferential partition plates being distributed in a radial direction from the center of the circle and having progressively increasing diameters; and the plurality of radial partition plates and the plurality of circumferential partition plates are combined to form a plurality of chambers.

4. The deep-sea manned submersible according to claim 3, wherein each of the radial partition plates is provided with a least two channels communicating with the chambers.

5. The deep-sea manned submersible according to claim 2, wherein a seal ring is disposed on a joint face between each bolt and the ring flange, and a sealing gasket is disposed on a joint face between the ring flange and the first half hull.

6. The deep-sea manned submersible according to claim 1, wherein a middle portion in the main hull body is a control chamber and the bottom portion thereof is an electromechanical equipment chamber.

7. The deep-sea manned submersible according to claim 1, wherein the propeller assembly comprises propellers and a secondary hull body; an arc-shaped groove is provided on the secondary hull body and two sliders are symmetrically disposed on two opposite inner side surfaces of the groove; the main hull body is inserted into the arc-shaped groove so that the two sliders are fitted into the two corresponding annular sliding channels; an outer contour of a whole body formed by the secondary hull body and the main hull body takes a nautilus shell shape; at least two propellers are disposed and separately mounted on the upper surface of the secondary hull body; and the brake is mounted on the same surface of the secondary hull body as the propellers.

8. The deep-sea manned submersible according to claim 7, wherein four propellers are disposed, two of which are mounted in a forward direction and the other two are mounted in a reverse direction.

9. The deep-sea manned submersible according to claim 1, wherein the brake comprises an air cylinder, an air cylinder base, and friction plates; the air cylinder is mounted on the propeller assembly via the air cylinder base; and two friction plates are disposed, and oppositely mounted on two opposite sides of the brake disc and connected to the air cylinder.

10. The deep-sea manned submersible according to claim 2, wherein a middle portion in the main hull body is a control chamber and the bottom portion thereof is an electromechanical equipment chamber.

11. The deep-sea manned submersible according to claim 3, wherein a middle portion in the main hull body is a control chamber and the bottom portion thereof is an electromechanical equipment chamber.

12. The deep-sea manned submersible according to claim 4, wherein a middle portion in the main hull body is a control chamber and the bottom portion thereof is an electromechanical equipment chamber.

* * * * *